US005524692A

United States Patent [19]

John

[11] Patent Number: 5,524,692

[45] Date of Patent: Jun. 11, 1996

[54] VERTICAL BLIND RETRACTION APPARATUS WITH SPACING CONTROL

[75] Inventor: Mark W. John, Redondo Beach, Calif.

[73] Assignee: Back Tracker, Inc., Redondo Beach, Calif.

[21] Appl. No.: 206,141

[22] Filed: Mar. 7, 1994

[51] Int. Cl.[6] ..... E06B 9/36

[52] U.S. Cl. ..... 160/168.1; 160/173

[58] Field of Search ..... 160/168.1 V, 176.1 V, 160/900, 178.1 V, 166.1 R, 173 V

[56] References Cited

U.S. PATENT DOCUMENTS

| | | | |
|---|---|---|---|
| Re. 33,216 | 5/1990 | Marocco . | |
| 345,313 | 7/1886 | McClure . | |
| 2,207,393 | 7/1940 | Anderson . | |
| 4,293,021 | 10/1981 | Arena . | |
| 4,316,493 | 2/1982 | Arena . | |
| 4,732,202 | 3/1988 | Anderson . | |
| 4,936,370 | 6/1990 | Uecker et al. . | |
| 4,993,469 | 2/1991 | Moench . | |
| 5,048,586 | 9/1991 | Howald . | |
| 5,095,966 | 3/1992 | Rogers . | |
| 5,168,913 | 12/1992 | Haines . | |
| 5,289,863 | 3/1994 | Schon | 160/178.1 V X |

FOREIGN PATENT DOCUMENTS

3241467A1 5/1984 Germany .

*Primary Examiner*—Blair M. Johnson
*Attorney, Agent, or Firm*—Fulwider, Patton, Lee & Utecht

[57] ABSTRACT

Trucks carried on a window track and mounting grippers operative to grip a retraction cord operative to when the tracks are deployed in a spaced relation, grip a retraction cord to be carried rearwardly toward the parked position when the cord is retracted. The grippers are operative upon the tracks reaching a parked position to release the cord for continued retraction of the cord relative to the parked truck so that continued retraction will draw the remaining tracks to parked position.

23 Claims, 4 Drawing Sheets

FIG. 1
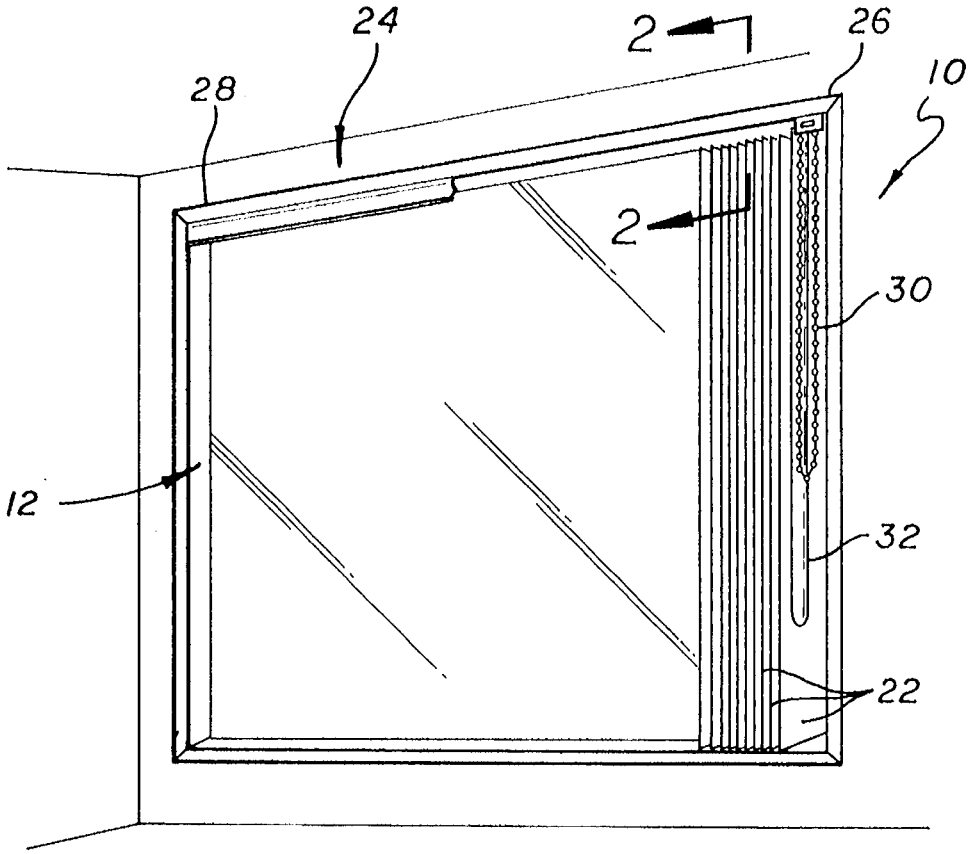
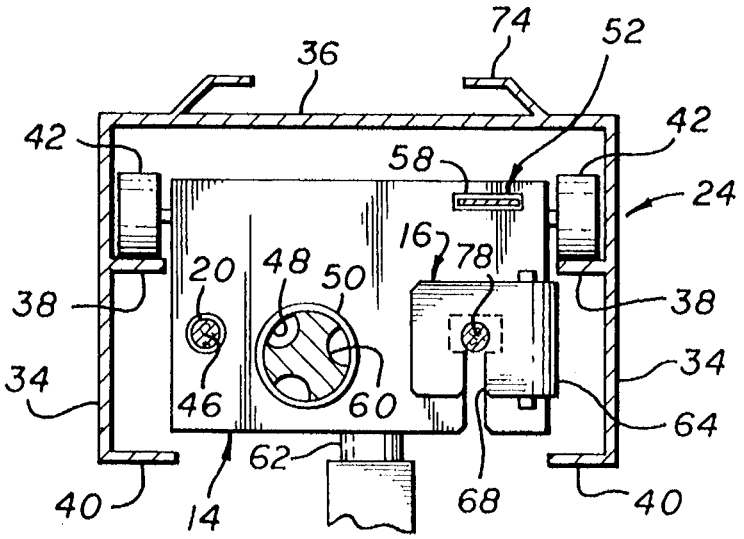
FIG. 2

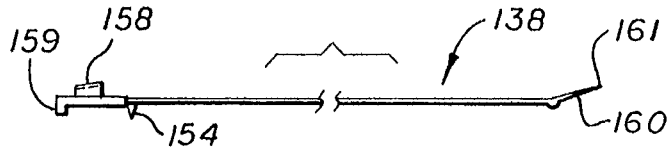
FIG. 10
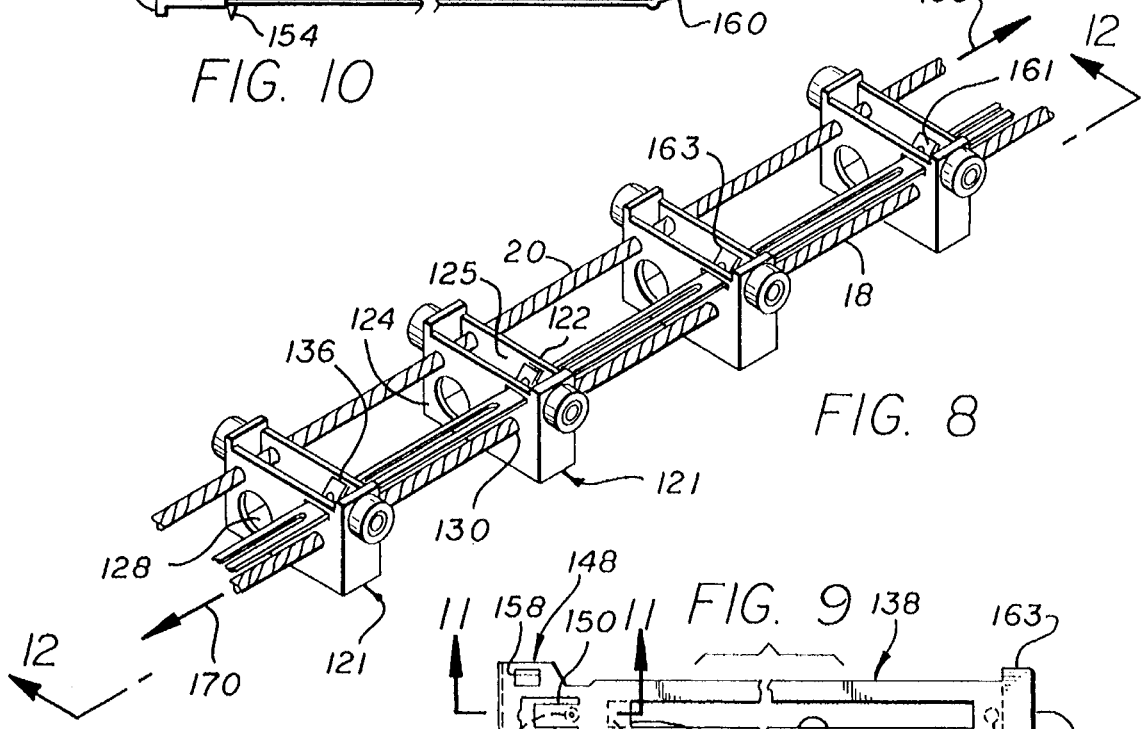
FIG. 8
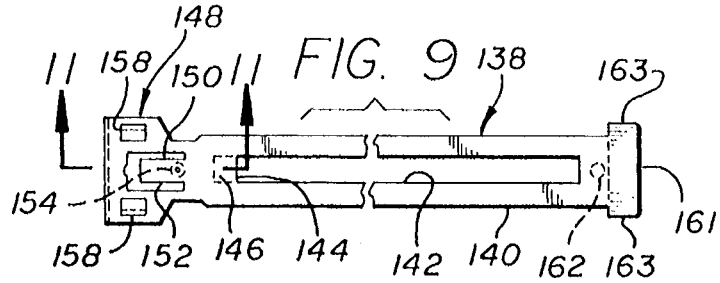
FIG. 9
FIG. 11
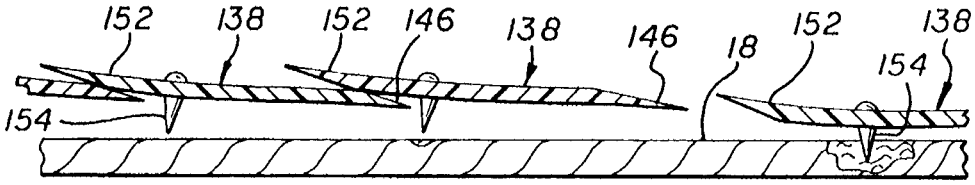
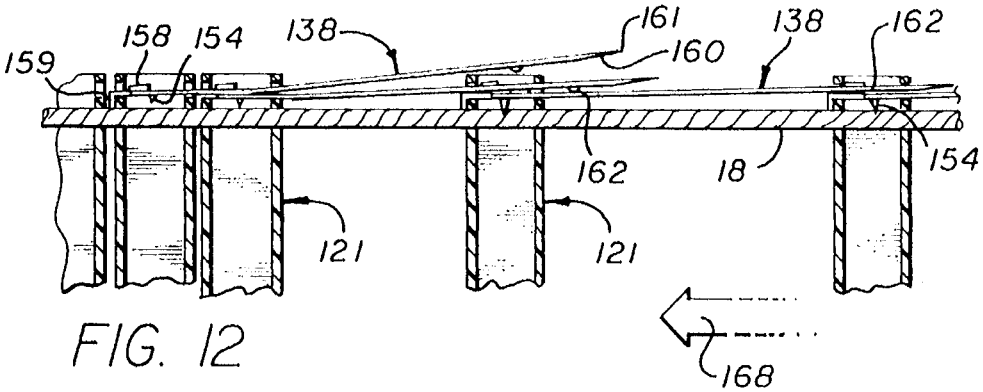
FIG. 12

VERTICAL BLIND RETRACTION APPARATUS WITH SPACING CONTROL

BACKGROUND OF THE INVENTION

1. Field of the Invention

The present invention relates to a vertically suspended hung window covering apparatus that improves spacing the way vertical blades or pleats are retrieved.

2. Description of the Prior Art

In the field of interior decoration, there is constant demand for improvements that affect both form and function of a product. Engineered improvements can not only improve the more practical qualities of a product but can have a direct impact on the aesthetic quality of the overall product. Home decorum products such as window blinds that have a functional and decorative aspect will receive notice from scrutinizing professionals and discerning consumers when they operate in a manner that preserves the aesthetic qualities of the product during operation.

Vertical window coverings have become increasingly popular in the interior design and home decorum industry because of their graceful sleek appearance and practical design. From a practical standpoint; vertical blinds are a simple, low maintenance, alternative to drapes, horizontal blinds, and roll blinds. Louver blinds take up little window space when retracted. When deployed, the blinds can be rotated and adjusted to control entry of sunlight. If desired, the window covering can effectively be rotated to block all vision and light through the window. The individual window covering blades can be easily removed, cleaned, and replaced. Such simplicity eliminates the need for professional blind or drape cleaners and reduces maintenance time and expense.

The aesthetic qualities of the louver blinds are also important to its overall commercial success. The louver blinds have attractive parallel lines, evenly spaced window blades. Perhaps the most significant quality of the louver blind is the interaction of sunlight with the blind. Evenly spaced parallel blades create a warm array of sunlight in a room casting a distinct visual pattern of light. Preserving the even spacing during operation and maintaining the orderly visual pattern at all times would be a significant improvement to the art of window coverings.

Vertical blinds from the prior art are described in U.S. Pat. Nos. 4,293,021, 4,316,493, 4,732,202, Re. 33,216, 4,936,370, 4,993,496, and 5,095,966. They are typically suspended from a track that extends across the top of the window. Each track contains several carriers or trucks that conform to the inner dimensions of the track and run along the track. A pulley and rope mechanism typically extends and retracts the trucks. From the truck extends a clasp that holds the window covering blade in place. Most prior art mechanisms have an arrangement for simultaneous rotation of the clasps.

The blades extend the height of the window. They are, when fully deployed, evenly spaced apart. They are of sufficient width to slightly overlap with neighboring blade when rotated to block out the window.

Horizontal displacement of the blinds is typically achieved by a rope and pulley mechanism extending the length of the track. Such a mechanism is illustrated in U.S. Pat. Nos. 4,293,021 and 4,316,493. The rope is fastened to the truck positioned farthest from the parked end of the track called the lead truck. The parked end of the track is the end of the track where the window blades are collected when the blinds drawn to a collected position. When the trucks are pulled from its parked positions they travel a set distance defined by spacers. The respective spacers latch the respective trailing trucks to their respective trailing neighbors. This chain reaction continues until all of the trucks are deployed in spaced relation across the window.

The method of deployment contributes to the attractive design of the blinds. When the blinds are in parked position, they are neatly collected at one side of the window. When some or all of the blinds are deployed across the window, they are uniformly spaced apart. This maintains the attractive visual pattern even when the blinds are in motion.

The blinds are retrieved by pulling the same cord in the direction opposite that for deployment of the blinds. The lead truck is pulled inward and bumps against the next truck and so forth. This causes the blinds being retrieved to successively bunch up together against the blind carried by the lead truck thus destroying the spaced visual pattern established for the central window area by leaving a clump of blinds centrally located in the window.

The unsightly bunching of window blades adjacent the distal truck in the prior art retrieval systems has practical disadvantages. Since the blades congregated farthest from the parked position tend to bind slightly in their travel and present momentum resisting retrieval such, retrieval is unavoidably more difficult thus detracting from the smoothness of operation. Another disadvantage is apparent particularly when the louver blinds cover sliding glass doors. Often, the blinds are retrieved from covering the whole window to covering part of the window to allow persons to walk through the door. Prior art blinds collect the bulk of the blades closest to the central high traffic area making the bulked together blinds most vulnerable to damage or strain.

Engineers and designers in the window covering industry have for many years developed many different variations of the louver blind mechanism. These systems typically deploy the blades across the window to preserve an equally spaced apart repetitive pattern as the blades are deployed. By way of example, see U.S. Pat. No. 4,293,021; U.S. Pat. No. 4,316,493, FIGS. 2–3, No. 26; and U.S. Pat. No. 4,993,469, FIGS. 5–7; The need for even spacing of the blinds is essential to the success of the louver blind. Prior mechanisms typically do not maintain the blinds evenly spaced as they are retrieved from a window covering position to a collected parked position at one end of a track.

SUMMARY OF THE INVENTION

The present invention is a novel apparatus within a vertical blind assembly that retrieves blinds while maintaining a uniform repetitive pattern. The apparatus is designed to be compatible with cord and pulley apparatus that are in common use in the industry to deploy and retrieve window blinds. Releasable grippers are mounted on trucks that carry window blades across the window. The grippers fit over the cord that retrieves the trucks. The grippers bind the cord when the cord is pulled in a direction that retracts the blinds towards a parked position.

The grippers are released when they come in contact with an adjacent stationary truck at the parked end of the track. The grippers do not bind the cord when the cord is pulled in an opposite direction to disperse the blinds. Thus the grippers do not interfere with the uniform dispersion of the blinds and operate to retrieve the blinds and maintain uniformity.

The advantage of the blind retrieval system is apparent to discriminating consumers and home decorum professionals. The retracted blinds are always collected neatly to one side of the window. The blinds that are dispersed across the window are always evenly spaced even during retrieval of the blinds to parked position. Bunching and clumping of the blinds causing a cluttered look in the middle of the window is eliminated.

Other aspects and advantages of the present invention will become apparent from the following more detailed description taken in conjunction with the accompanying drawings.

BRIEF DESCRIPTION OF THE DRAWINGS

FIG. 1 is a perspective view of a vertical blind apparatus embodying the present invention mounted on a window;

FIG. 2 is an enlarged transverse sectional view of the vertical blind track taken along the line of 2—2 in FIG. 1;

FIG. 8 is a perspective cut away view of a third embodiment of the vertical blind apparatus of the present invention;

FIG. 9 is a broken enlarged top view of a coupling strip and gripper mechanism included in the vertical blind apparatus shown in FIG. 8;

FIG. 10 is a side view of the coupling strip shown in FIG. 9;

FIG. 11 is a diagrammatic view, depicting operation of the coupler strip as if taken along the lines of 11—11 of FIG. 9 but in reduced scale; and FIG. 12 is an enlarged, broken, longitudinal sectional view of the vertical blind apparatus taken along the line 12—12 of FIG. 8.

DESCRIPTION OF THE INVENTION

Figure 3:
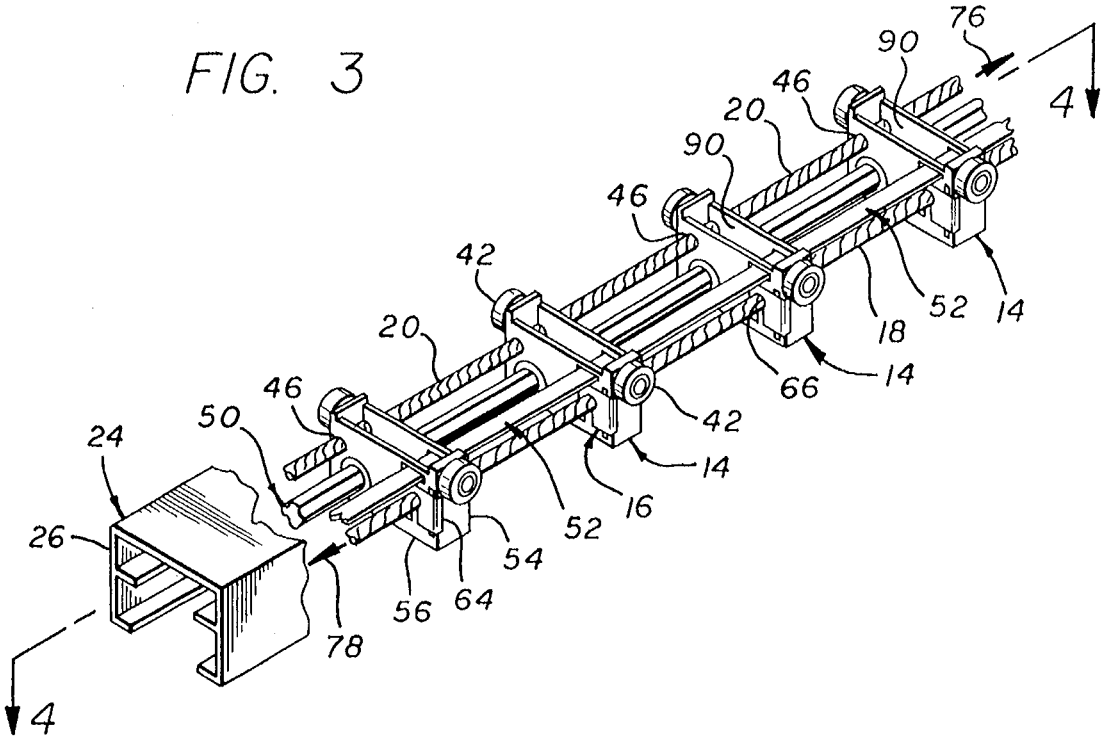
FIG. 3 is an enlarged scale perspective view, partially broken away, of the vertical blind apparatus shown in FIG. 1.

The present invention is a retrieval device for a vertical louver blind window covering apparatus illustrated in FIGS. 1 and 2. The retrieval system operates in a horizontally disposed vertical blind track apparatus, 10 that extends horizontally over the window 12. Within the track apparatus 10 are several trucks, generally designated 14 that run freely along the length of the track apparatus. Each truck has a gripper, generally designated 16, affixed thereto. The opposite runs 18 & 20 of a cord 32 project through longitudinal openings in the respective track with the run 18 being selectively gripped by the gripper 16. The gripper 16 binds into the cord when the cord is pulled in a direction that retracts the blinds from extended position to parked position. When the truck is pulled into an adjacent parked truck the gripper is released from the cord. This allows the cord to pass freely through the trucks without undue friction. When the cord 32 is pulled to extend the window blades 22 over the window 10 the grippers 16 are to allow for tree extension of the cord through the respective trucks to allow for orderly deployment of such trucks 14.

FIG. 1 shows a window 10 fitted with a downwardly opening elongated channel shaped track 24 extending along the entire width of the window 10. The track receives several trucks 14 (shown in FIG. 2) from which hang respective equally sized vertical window covering blades 22. The blinds are collected at one end of the window defined as the parked position 26 and are deployed toward the opposite end 28 (FIG. 1). Two controls 30 & 32 hang from the parked end of the window. The first is the deployment/retrieval cord 32 which translates the trucks 14 from parked position to an extended position covering the window 12. The second control 30 is operative to rotate the window blades 22 to the desired angle relative to the respective trucks.

Referring now to FIGS. 2 and 3, the track 24 may be made of metal or plastic and is channel shaped to form two sidewalls 34 that extend vertically downward from a top wall 36. A pair of confronting runners 38 extend horizontally inwardly from the sidewalls 34 just below the top wall 36. The side walls of the preferred embodiment are formed at lower extremity with inturned flange 40 projecting inward from each wall.

The trucks are typically constructed of plastic and are box shaped to be formed with respective front and rear walls 54 and 56 defining an upwardly opening compartment 90 and carried on their laterally opposite sides from respective wheels 42 which ride on the respective runners 38 (FIG. 2). The respective front and back walls 54 and 56 are themselves formed on towards their laterally opposite sides with respective bores 44 and 46 for receipt of the respective runs 18 and 20 of the cord 32 for free telescopical passage therethrough. Also formed in respective such trucks are respective enlarged in diameter through bores 48 which receive an elongated longitudinal control rod 50 carried rotatably at its opposite ends by respective sockets formed in the opposite ends of the track 24.

The cord 32 is threaded through the deployment run bores 46 from the lead truck defined as the outermost situated truck in the assembly through each successive truck 14. The cord 32 is looped around and threaded back through the trucks from the end truck to be situated closest to the parked end 28 of the track 24. The total length of the cord is sufficient to be threaded twice through the track length plus an additional length necessary to hang down from the track for manual control 32. The portion of the cord that passes through the deployment run bores 46 is referred to as the deployment run 20 and the portion of the cord oriented through the retrieval run bores 44 will be referred to as the retrieval run 18. One end of the retrieval run 18 is directly affixed to the lead truck. The deployment run 20 passes through the deployment run bores 46 in the lead truck. It is then looped around a pulley (not shown) affixed to the outer extremity of the track and is directed back to the lead truck and affixed thereto.

Referring now to FIG. 3, each truck 14 is connected to its neighboring truck 14 by a conventional spacer strip, generally designated 52. The spacers 52 may be constructed as those shown in U.S. Pat. No. 4,293,021 to Arena and are preferably in the form of flexible plastic strips, or possibly stainless steel, carried on their respective one ends from respective trucks 14 and projecting telescopically through the respective slots 58 to be formed on their respective tree ends with enlarged crimps to act as respective stops.

The driver rod 50 is formed from a ¼ inch diameter cylindrical aluminum shaft and has a length equal to the length of the track 24. The driver rod is formed with a plurality of longitudinally extending grooves 60 running the length of the bar with equal radial spacing. The grooves 60 in the driver rod 50 act as a gear mechanism meshing with cooperating gear teeth at the top of respective hanging clasps 62 (FIG. 2) to, upon rotation thereof, rotate such clasps relative to the respective trucks 14 to adjust the angle of the respective suspended blades.

Figure 4:
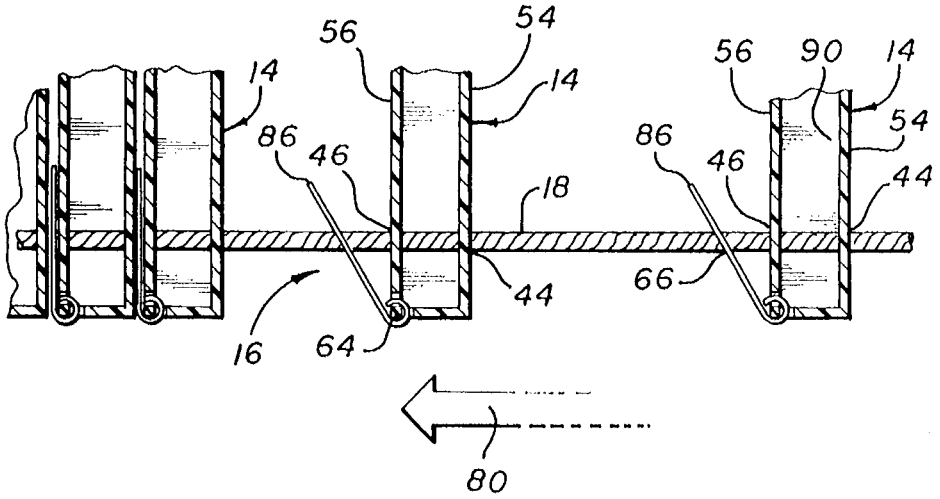
FIG. 4 is a longitudinal top sectional view, in enlarged scale and partially broken taken along the line 4—4 of FIG. 3.

The releasible grippers 16 are shown in FIG. 4 as square metal tabs 16 looped back along one side to be inserted through vertical slots in the corner of the respective trucks 14 to form respective hinges for free pivoting of the respective free ends of such tabs. Apertures 66 are formed centrally in the respective grippers 16 and aligned, when the grippers are collapsed against the respective trucks, with the retrieval run bores 46 and configured to frictionally receive the diameter of the retrieval run 18 so that the free end thereof will tend to be drawn in the direction of cord travel through such holes. A downwardly opening reduced in cross section slit 68 is formed in each gripper to form a key way shaped access to the respective apertures 66.

As will be appreciated by those skilled in the art the grippers 16 may be of any durable construction such as molded in the body of the trucks to form respective line hinges for actuation, it only be important that they move with the retrieval run 18 to draw to the extended gripping position and be collapsible to the retracted release position.

The trucks 14 and respective grippers 16 may be assembled with the cord 32 and the rod 50. The moving parts are received into the truck by threading the cord loop through the track from the outer extremity 28 toward the parked end 26 and out through an opening formed in the parked end of the track 24. The driver rod 50 is next inserted into the track 24 from the outer extremity and is coupled to an external drive means 30 capable of rotating the driver rod. The individual trucks are inserted into the track. The wheels 42 rest upon the runners 38 and the clasps 62 hang through the opening between the inturned flanges 40. The retrieval run pulley (not shown) is affixed to the outer extremity 28 of the track 24. The driver rod 50 is rotatably affixed to the outer extremity of the track and an end cap (not shown) is placed over the outer extremity of the track.

The window covering blades 22 can be hung from the clasps 62 hanging from each truck 14. The track 24 is mounted to the top of the window frame 12. The mounting of the track is accomplished by affixing a mounting clip (not shown) to the upper surface of the window frame 12. A mounting bracket 74 that runs the length of the track can be clipped into the mounting clip and tightened.

Referring to FIGS. 1, 3 & 4, the blades 22 can be deployed across the window 12 from the parked position where the blades supported by the trucks 14 are collected against the parked end 26 of the track 24. When the user pulls down on the cord 32, corresponding to the deployment run 20, the lead truck is pulled outward in the track. The deployment run 20 (FIG. 3) is free to travel through the deployment run bore of the following trucks 14 in the direction of the directional arrow 76 (FIG. 3). As the lead truck 14 is advanced, the spacer 52, when the selected spacing from the following truck is achieved, will draw such following truck 14 along the track at the selected spaced interval. This procedure will continue for the composite distance the trucks are deployed along the length of the track. Meanwhile, the retrieval run 18 which is also connected on one end to the lead truck is free to pass through the respective bores 44 and apertures 66 in the respective trucks 14 and grippers 16 to allow such trucks to travel freely in a direction opposite the direction arrow 78. The retrieval run passes freely through the respective retrieval run bores apertures 44 without restriction while the slight frictional resistance of such run in the apertures 66 of the respective gripper serves to draw the free ends thereof to the right as viewed in FIG. 3 thereby tending to maintain the free ends rotated clockwise to their retracted positions and maintain the grippers 16 pressed against the confronting sides of the respective trucks. In this position, the gripper does not grip the retrieval run because the aperture in the gripper is likewise sufficiently large to allow the run to be pulled through the retrieval bore with minimal friction. Thus, the present invention does not interfere with the orderly manner of conventional truck deployment.

When it is desirable to retrieve the trucks from their deployed positions suspending the blades spaced across the window in covering relationship, the retrieval run 18 may be drawn. This causes the retrieval run 18 to move toward the parked end 26 of the track 24 as indicated by direction arrow 78 (FIG. 3). The deployment run 20 contrarily moves in an opposite direction as indicated by direction arrow 76. As illustrated in FIG. 4, the inward motion of the run 18 in the direction of arrow 80 causes the respective free ends of the respective tabs 16 on each truck 14 to be drawn to the left relative to the respective trucks to swing outward away from the body of the truck. As the free ends of the respective tabs pivot about their respective hinge ends, the gripper apertures 66 are pivoted out of alignment with the retrieval run bores 46 causing the run 18 to bind between the respective grippers and trucks so that the respective trucks will be drawn along therewith.

Since all the trucks are fitted with grippers, each truck simultaneously grips the retrieval run and is consequently pulled inward retaining the equal spacing between sequential trucks. This prevents the unsightly and impractical bunching of the blinds in the middle of the window 12 adjacent the most distal truck.

As the proximal trucks reach the retraction end of the track they will be sequentially stopped (FIG. 4) in their parked positions as the next sequential truck approaches the immediately preceding parked trucks 14. The free tip 86 of the gripper tab 16 of such next sequential truck will abut the front wall 54 of the immediately preceding parked truck. As the moving truck is pulled closer still towards the parked truck, the gripper is forced to pivot clockwise as viewed in FIG. 4 to be rotated into overlying relation against the back wall 56 of the parking truck to again align the respective gripper apertures 66 and run bores 44 to allow for free travel therethrough of the run 18 so that continued retraction of the run will continue to draw the deployed trucks toward their respective parked positions.

Figure 5:
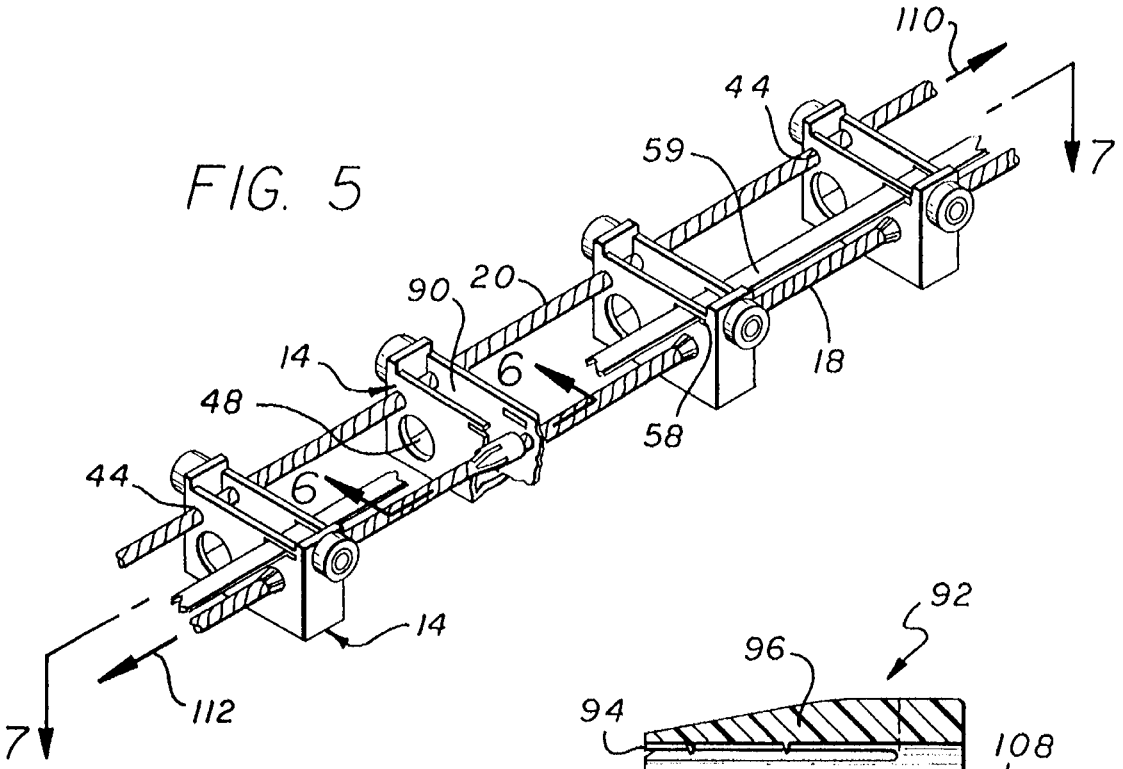
FIG. 5 is a cut away perspective view of a second embodiment of the vertical blind apparatus of the present invention.

The second preferred embodiment, as shown in FIG. 5 includes trucks 14 having the same rectangular box shape as the truck describe above to form a central compartment 90. The trucks are also formed on their front and back walls 54 and 56 respectively with passages 48, deployment run passages 44, and spacer bar passages 58 as described above. The front walls are formed with respective retrieval run passages 106 and the back walls with respective oversized gripper bores 104 aligned horizontally with the run passages 106. Frusto conical gripper grommets 92 are threaded over the retrieval run 18 and are held captive in the respective compartment 90.

The grommets 92 (FIG. 6) are constructed of flexible plastic and are each formed with a base ring 98 and a conical wedge nose 94. The respective wedge noses are formed with longitudinal radial projecting slits 100 to from therebetween equal cantilever mounted flexible gripper fingers 96 projecting longitudinally from the respective rings 98. Formed along the interior surfaces of such fingers are radially inwardly projecting barbs 102 for positively engaging the retrieval run when such fingers are flexed radially inwards. It will be appreciated that the inner diameter of the grommet 92 is sufficient to freely receive the retrieval cord run 18 in a loose fitting relationship so that the retrieval cord can pass through the grommet when the fingers 96 are in their relaxed position.

The grommets 92 are configured to be held captive on the retrieval run 18 and constrained in the respective compartments 90 between the respective front and back walls 54 and 56. The outside diameter of the grommets 92 are larger than the diameters of the respective run passage openings 106 and the respective conical wedge noses 96 are configured such that the respective tips 94 thereof will be received in the gripper bores 104 to, upon application of a relative axial force to the left in the direction of the directional arrow 114 in FIG. 7, cause such nose to be pressed against the walls of such bore 104 thereby urging the respective gripper fingers radially and inwardly to press the respective barbs 102 into penetrating engagement with the peripheral sides of the retrieval run 18.

Figure 6:
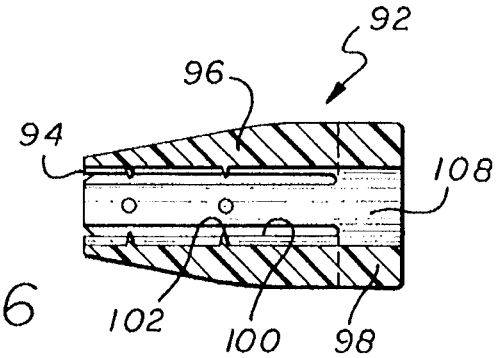
FIG. 6 is an enlarged cross sectional view taken along the line of 6—6 of FIG. 5.
Figure 7:
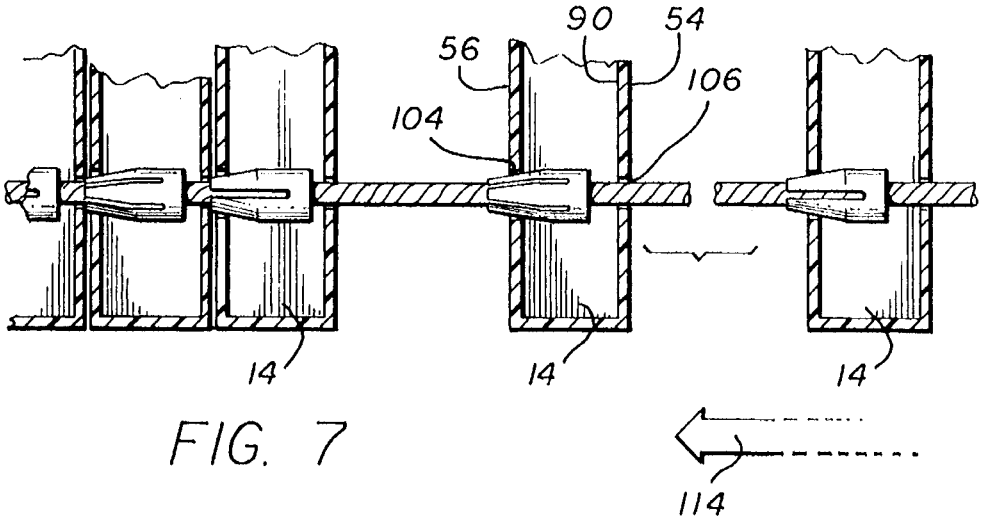
FIG. 7 is an enlarged, broken, longitudinal sectional top view taken along the line of 7—7 of FIG. 5.

In operation it will be appreciated that the embodiment of FIGS. 5–7 operates similar to that of the embodiment of FIGS. 1–4. In this regard, when the trucks are deployed by travel of the deployment run 20 to the right as viewed in FIG. 5, the spacer strips 59, commencing with the lead truck, will be operative to draw the respective trucks to their deployed spaced position.

Then, when the blind suspension apparatus is to be retracted, the operator will draw the retraction run 18 to the left in the direction of the arrow 112 in FIG. 5. It will be appreciated that drawing of such retraction run 18 to the left will cause the respective grommets 92 carried frictionally thereon to likewise be drawn to the left thereby causing the respective wedge noses 96 of the respective grommets to engage the respective gripper bores 104. The frictional resistance to movement to the left of the respective trucks will result in the respective trucks slightly resisting movement thereby resulting in the cord run 18 drawing the grommets 92 to the left with a force relative to the inertia of the respective trucks which is sufficient to cause the respective flexible gripper fingers to, at their left hand ends, be urged radially inwardly by the walls of the respective gripper bores 104 to engage the barbs 102 with the periphery of the run 18. Consequently, continued drawing to the left of the run 18 as viewed in FIG. 7 will result in the retracting trucks 14 to be drawn to the left to, as retraction continues, substantially maintain their initial spaced relationship occupied during full deployment. As the respective trucks approach the parked position in the left hand side of FIG. 7, it will be appreciated that the respective left hand ends of the respective grommets will engage the respective front walls 54 of the previously parked trucks about the marginal edges of the respective run passages 106 thus stopping such grommets against further movement to the left such that the nose tip contacts the previously parked truck thus abruptly stopping the grommet from further movement to the left while the momentum of the retracting truck carries on to the left to strike the previously parked truck and, at the same time, move the respective gripper bore 104 to the left on the respective grommet nose 96 thereby treeing the left hand ends of the respective fingers 96 to flex radially outwardly thereby disengaging the respective barbs 102 from the periphery of the cord run 18. This then leaves the retrieval run 18 free to continue traveling to the left and through the respective grommets of the parked trucks. This then allows the remaining trucks to be withdrawn from their spaced deployed position in sequence to be sequentially stacked at the parked location.

Referring to FIGS. 8–12, the third disclosed embodiment of the window covering apparatus of the present invention includes, generally, trucks 121 formed with front and rear walls 122 and 124. The front and rear walls are formed with the usual deployment run bores 126, control rod bores 128, retraction run bores 130, and respective gripper slots 136 into which are received respective gripper strips, generally designated 138. Each such gripper strip being carried at its rear extremity from an adjacent truck.

The respective gripper strips 138 are formed at their respective rear extremities with down turned flanges 159 to limit movement of the respective strips to the right as viewed in FIG. 12 relative to respective trucks. The strips 138 include, generally, a longitudinal strip body 140 formed centrally with an elongated window defining a path 142 configured rearwardly with a lifter tongue 144 having a upwardly facing wedge surface 146. Such strips 138 are formed at their respective rear extremities with laterally enlarged heads, generally designated 148, which are, in turn, formed centrally with a U-shaped cutout 150 leaving respective cantileverly extending resilient gripper fingers 152 projecting towards the rear of the respective strips (FIG. 9). The rearwardly projecting gripper fingers mount at their rearward extremities respective downwardly projecting gripper barbs 154 which are configured to imbed in the retrieval run when such gripper fingers are in their respective relaxed position showed pictorially on the right hand side of FIG. 11.

The respective spacer strip heads 148 are formed with respective angle shaped ears 158 which project upwardly and turn inwardly to define therebetween a path for slidable receipt of the body 140 of the adjacent strip 138. The strip 138 is formed on its front extremity with an upturned angular lift tab 161 and has mounted on the bottom side thereof adjacent such tab a downwardly projecting actuator head 162 arranged to, when the adjacent strips are in their extended position, be positioned over the top of the finger 152 of the adjacent strip to maintain the underlying barb 154 pressed down into positive engaging position with the retrieval run as shown on the right hand side of FIG. 11.

In operation, the trucks 121 may be deployed by drawing on the deployment run to draw the run 20 to the right as viewed in FIG. 8 opposite the direction of the directional arrow 166. This serves to draw the lead truck to the right thereby causing the trucks to move in the direction opposite that of the directional arrow 168 shown in FIG. 12. As the trucks deploy to the right from their parked position, the body 140 of the strip will ride downwardly on the top of the adjacent truck to cause the forward end thereof to be received downwardly into the top end of the respective truck compartments 125 to position the laterally projecting tabs 161 therein in alignment within the respective slot 136 thus causing the laterally projecting ears 163 thereof to engage the opposite sides of the respective slot 136 to cause the strip 138 to then be drawn to the right resulting in the adjacent truck to which it is tethered to likewise be drawn to the right thus causing the trucks to be sequentially drawn from their parked position in spaced relation to thereby assume a spaced relation across the top of the track. This procedure will then be continued for the distance the cover is to be drawn across the window.

It will be appreciated that as the individual trucks reach the full extent of their spaced relationship, as indicated by the pair of trucks in the right hand side of FIG. 11, the right hand end of the strip 138 downwardly to maintain the associated barb actuator head 162 urged downwardly over the underlying finger 152 to positively urge the barb 154 into penetrating engagement with the retrieval run 18.

Subsequently, when it is desirable to retract the window covering, the retraction run 18 is drawn to the left in FIG. 8 in the direction of the directional arrow 170. This results in all trucks being drawn to their left in the spaced relation dictated by the strips 138.

When a truck 121 reaches its parked position, it will engage a previously parked truck thus causing the incoming truck to stop thereby stopping the travel of the associated strip 138. This will then result in the head 148 of the next adjacent strip sliding to the left relative to the stop 161 of the truck which has just been parked. This will result in the containment ears 158 sliding to the left on the body 140 of the strip that has just been parked thus freeing the right hand end of that strip to be raised to thereby disengage the actuator head 162 from the underlying finger 152 to thereby release the associated barb 154 to be raised from penetrating relationship with the run. Concurrently, the top of the truck wall will engage the underside of the lifter tab 160 thereby causing the right hand end of such strip of the parked truck to be further raised as the incoming truck continues traveling to the left as viewed in FIG. 11. Then, as the gripper finger 152 of the retracting truck travels to the left in the path 142 of the already stationary spacer strip 138 of the previously parked truck, the left hand end of such gripper finger 152 will engage the stationary lifter tongue 144 and ride up the wedged surface 146 to raise the left hand end of such finger as shown in FIG. 11 to positively raise the underlying barb 154 free of the retrieval run 18 to free for continued free travel to the left relative to the truck as it assumes its parked position.

From the foregoing it will be apparent that the vertical window covering track apparatus of the present invention provides an economical and reliable means for, when the covering is retracted, retracting the vertical elements in equal spaced sequential relationship. The invention provides an arrangement which does not interfere with deployment by conventional track mechanisms. The arrangement serves to bunch the retracting trucks at the park end of the track rather than centrally on the track positioned in an unsightly arrangement central in the window or door to be viewed by observers and to interfere with the path of users who may want to walk through a doorway covered by the covering.

The foregoing discussion of the present invention is not written to limit the invention. Various modifications and changes may be made without departing from the spirit of the invention.

What is claimed is:

1. A horizontal track apparatus, covering elements for suspending a plurality of vertical window coverings to spaced positions over a window and comprising:

an elongated horizontal track projecting from a rearward retraction extremity horizontally in a forward direction to an extended extremity;

a plurality of trucks mounted in said track, each including hangers for hanging a respective said vertical window covering element therefrom;

a control cord carried by said trucks and including deployment and retraction cord runs to be drawn in respective extension and retraction directions to respectively deploy and retract said trucks on said track to and from said retraction end extremity;

grippers carried by said respective trucks, said grippers being operative upon said retraction run being drawn in said retraction direction to draw the respective said trucks from their respective deployment positions to grip said retraction run to draw the respective said trucks in said retraction direction and further being operative upon the respective trucks reaching said retraction extremity and assuming a parked position to release said retraction run for continued travel thereof relative to the respective truck in said parked position.

2. A horizontal track apparatus as set forth in claim 1, wherein:

said grippers are in the form of tabs pivotally mounted on the rear sides of the respective said trucks for rotation about a vertical axis and including a central cord passage receiving said return run, said tab being operative upon drawing of said cord in said return direction to pivot the respective said gripper tabs to bind said release run in said passage.

3. A horizontal track apparatus as set forth in claim 2, wherein:

said tabs are positioned such that, as the respective trucks retract from said deployment positions cause the free end of the respective tabs to engage preceding trucks parked in said parked position to cause the respective said tabs to be rotated to align the respective said passages with said cord run to ungrip said cord run and free said cord run for travel relative thereto.

4. A horizontal track apparatus as set forth in claim 1, wherein:

said truck includes front and rear walls spaced apart to form a control compartment, said front and rear walls including, respectively, cord passages for passage of said retraction cord run and a gripper bore; and the respective said grippers each include a ring encircling said retraction cord run and a plurality of longitudinally projecting resilient gripper fingers cooperating to surround said cord run and formed exteriorly with rearwardly and inwardly inclined wedge surfaces cooperating to form a gripper nose for projecting through the respective said gripper bores, said fingers being formed interiorly with radially inwardly projecting barbs for, where the respective said fingers are flexed radially to respective engagement positions, engaging said cord run, said fingers being so configured that when said retraction cord run is drawn in said retraction direction, the respective said grippers will be drawn with said cord to project the respective noses thereof into the respective gripper bores of deployed trucks such that the insertion of the respective deployment truck will cause the respective said fingers to be flexed radially inwardly to the respective said engagement positions to engage the respective said barbs with said cord run such that further retraction of said cord run will cause the respective said grippers to be carried with the retracting chord run to draw the respective said trucks in said retraction direction.

5. A horizontal track apparatus as set forth in claim 4, wherein:

the respective said gripper noses are configured to, when engaged in the respective said gripper bores, project rearwardly beyond the respective said rear walls of said trucks such that as the respective said trucks are retracted to said parked position, the respective said noses of the gripper of the retracting trucks will, in sequence, engage the respective said front walls of the previously parked truck to sequentially stop travel of the gripper so engaged to allow the retracting truck of the gripper so engaged to continue moving rearward in said retraction direction to free the respective gripper fingers to flex radially outwardly from the respective said engagement positions to disengage the respective said barbs from said retractor cord run to free said cord for relative travel.

6. A horizontal track apparatus as set forth in claim 1, wherein:

the respective grippers include respective spacer strips coupled between adjacent trucks and including rearwardly projecting flexible gripper fingers, each normally in an engagement position and flexible to a disengaged position, said fingers each further including respective downwardly projecting barbs configured to, when each said finger is in its engagement position, engage said retraction cord run and to, when said fingers are in said retracted positions disengage said cord, said fingers still further including respective downward facing ramp surfaces, said strips further including respective forwardly projecting lifter tongues configured and arranged to, when said retractor cord run is drawn in said retracting direction to draw a truck from a deployed position rearward toward said park position, cause the lifter surface of fingers of the strip of said truck being retracted to engage the lifter tongues of the immediately previously parked truck to lift the engaged finger to its retracted position to free said retraction cord run for free travel with respect thereto.

7. A horizontal track apparatus as set forth in claim 6, wherein:

said strips include respective barb actuators engageable, when said trucks are deployed to their respective spaced relation, with the gripper finger of the adjacent strip to urge the gripper finger so engaged into its engagement position.

8. A horizontal track apparatus as set forth in claim 6, wherein:

each said strips include respective guides for telescopical receipt of adjacent strips to guide the relative movement thereof.

9. A horizontal track apparatus as set forth in claim 6, wherein:

said front and back walls of said truck includes respective slots for telescopical receipt of said strips; and said strips are formed at their opposite ends with respective stops for engaging the respective stops for engaging the respective said trucks to limit the distance said trucks can be spaced apart in said track.

10. A horizontal track apparatus as set forth in claim 9, wherein:

said strips are formed with longitudinal paths for travel therein of the respective fingers of the adjacent strips and formed at the respective one ends with the respective said tongues.

11. A horizontal track apparatus as set forth in claim 7, wherein:

the respective said strips are formed at the forward extremities with raised lifter tabs adjacent the respective said barb actuators and arranged to, when a retracting truck approaches said parked position, engage the top wall of said retracting truck to raise said actuator out of engagement with the gripper finger of the adjacent strip.

12. A horizontal track apparatus including a plurality of trucks extendable by a cord device to be deployed forwardly to deployed positions spaced longitudinally apart at respective predetermined distances for suspension therefrom of respective vertical elements of a window covering and comprising:

a retraction cord coupled with said cord device and disposed in said track for retracting said plurality of trucks from said deployed positions to a parked position rearward respective parked positions adjacent one extremity of said track; and releasible grippers mounted on the respective said trucks for receipt of said retraction cord and operative upon drawing of said retraction cord from a deployed position toward said one extremity of said track to grip said cord to, upon continued retraction of said cord, draw the respective trucks toward said one extremity and to, upon engagement with a preceding truck parked at said parked position, release said retraction cord to provide for free passage of said cord relative to the respective said gripper.

13. A horizontal track apparatus according to claim 12 wherein:

said grippers include respective clamps mounted on the respective said trucks and extendable to respective extended positions gripping said cord and positioned on the respective said trucks to, upon engaging preceding trucks bunched at said park position, be driven to respective retracted positions disengaging said cord.

14. A horizontal track apparatus according to claim 1 wherein:

said trucks are formed with respective bores of respective predetermined diameters defining respective passages;

the respective said grippers include grommets carried on said cord adjacent the respective said trucks for, upon retraction of said cord, engaging the walls of said bores to, upon continued retraction of said cord, draw the respective said trucks toward said park position and including respective flexible fingers formed with gripping elements normally engaging said cord, the respective said fingers being configured to, upon the respective said truck approaching the respective preceding truck bunched at said park position, engage the respective said preceding truck to, upon further retraction of said cord, release the respective said gripping elements from said cord to free said cord to pass through the respective said grommets.

15. A horizontal track apparatus according to claim 1 wherein:

the respective said grippers include respective resilient longitudinally projecting gripper fingers projecting rearwardly toward said park position and carried cantileverly on their respective forward ends from the respective said trucks and deflectable on their respective free ends from their respective normal positions to respective deflected disengaged positions, the respective said fingers including respective laterally projecting barbs projecting from said free ends for, when the respective said fingers are in their respective normal positions, engaging said cord and to, when in their respective deflected positions, be disengaged from said cord, said grippers further including respective release tongues mounted from the respective said trucks and projecting therefrom in a direction away from said park position for, upon approach of an adjacent truck drawn toward a parked truck at said park position, engaging the finger carried from said adjacent truck to shift the respective finger of said adjacent truck to the respective said release position to disengage the respective barb from said cord to free said cord for free travel relative to said adjacent truck.

16. A horizontal track apparatus according to claim 1 wherein:

the respective said trucks include respective longitudinal through strip receiving slots arranged in longitudinal alignment and with respective passages formed adjacent thereto for passage of said retrieval cord:

respective resilient elongated coupling coupler strips carried on their respective one ends from respective trucks and received telescopically in the respective said slots of adjacent trucks and formed on their respective truck to limit separation of adjacent trucks to said predetermined distances; and the respective said grippers including respective elongated resilient fingers carried on their respective one ends from the respective said trucks and formed with respective free ends and including respective laterally projecting barbs for, when the respective said fingers are in their normal positions engaging said cord to stop relative movement between said cord and the respective truck, said grippers further including release tongues carried from the prospective said trucks and operative upon adjacent trucks being moved together into close spaced relation to engage and deflect the respective free ends of the respective engaged fingers to disengage the respective barbs from said cord.

17. An elongated window track apparatus for suspending a plurality of vertical window coverings in spaced positions over a window and comprising:

an elongated track;

a plurality of trucks mounted slidably in said track and including respective grippers confined thereto:

a control cord threaded through and carried by said trucks to be drawn in respective deployment and retrieval directions;

said grippers operative to, in response to drawing said cord in said respective deployment and retrieval directions, correspondingly be releasable and engageable with said control cord.

18. An elongated window track apparatus according to claim 17 wherein:

said trucks include front and rear walls and formed with deployment run freely threaded through said deployment bores, and a retrieval run freely threaded through said retrieval bores, said deployment and retrieval runs operable to move in opposite directions upon drawing of either of said runs.

19. An elongated window track apparatus according to claim 18 wherein:

said grippers are respectively formed with tabs having free ends and mounted pivotally to the rear walls of said trucks and including respective centrally formed apertures for receiving said retrieval run and substantially aligned with said retrieval bores of said trucks;

said retrieval run threads through said retrieval bores and said gripper apertures thereby tending to pivot said grippers in the direction of cord travel;

whereby said apertures directly align with said retrieval bores to allow free travel of said cord during deployment of said trucks and pivot out of alignment with said bores during retrieval of said trucks causing said apertures to bite into said retrieval run and draw said truck therewith to a parked position.

20. An elongated window track apparatus according to claim 19 wherein:

said free ends of said grippers are formed to pivot and re-align said apertures with said vertical bores upon contacting said front walls of parked trucks enabling said retrieval run to freely pass therethrough.

21. An elongated window track apparatus according to claim 18 wherein:

said retrieval bores formed into said rear walls of said respective trucks is formed undersized;

said grippers, respectively, comprise an oversized in diameter ring formed with axially projecting fingers flared inwardly to form a flexible reduced-in-diameter nose, said fingers formed internally with barbs directed radially inward, said grippers interposed between said retrieval bores with said gripper nose positional proximate to said undersized bore;

said retrieval run of said cord threads through said retrieval bores and axially through said gripper;

said grippers operative to, during deployment of said trucks, allow free travel of said cord therethrough, and also operative to, in response to retraction of said retrieval run, engage said undersized bore with said nose to flex said finger barbs inwardly to engage said run and draw said truck therewith to a parked position.

22. An elongated window track apparatus according to claim 21 wherein:

said reduced-in-diameter nose is formed to extend through said undersized bore during engagement thereof, and project outwardly from the rear wall of the said truck to, upon contacting said front walls of parked trucks, pop out of said bore and enabling said retrieval run to freely pass through said gripper.

23. A method of maintaining a constant spacing between the vanes of a vertical blind assembly, having art elongated track and a plurality of initially deployed evenly spaced vane carrying trucks mounted in said track, said trucks carrying a control cord with deployment and retrieval runs and respectively carrying releasable control cord grippers, during retraction to a parking position, said method including the steps of:

drawing said control cord in a retraction direction;

clamping said evenly spaced trucks simultaneously to said control cord through said grippers in response to said cord retraction;

carrying said trucks along said cord in said retraction direction;

releasing said grippers from said cord sequentially upon reaching a parking position and freeing said cord for continued travel;

stacking said trucks horizontally into compressed relation upon reaching said parking position.

* * * * *